US006684510B1

(12) United States Patent
Collins

(10) Patent No.: US 6,684,510 B1
(45) Date of Patent: Feb. 3, 2004

(54) SELF LOCKING FOLDING KNIFE

(76) Inventor: Walter W. Collins, P.O. Box 100, North, SC (US) 29112

( * ) Notice: Subject to any disclaimer, the term of this patent is extended or adjusted under 35 U.S.C. 154(b) by 19 days.

(21) Appl. No.: 10/103,219

(22) Filed: Mar. 21, 2002

Related U.S. Application Data

(60) Provisional application No. 60/333,042, filed on Nov. 19, 2001.

(51) Int. Cl.[7] ..... B26B 1/04
(52) U.S. Cl. ..... 30/161; 30/155
(58) Field of Search ..... 30/158, 159, 160, 30/161, 155

(56) References Cited

U.S. PATENT DOCUMENTS

| | | | | |
|---|---|---|---|---|
| 1,315,503 A | * | 9/1919 | Hughes | 30/159 |
| 4,177,560 A | * | 12/1979 | Sakurai | 30/160 |
| 4,451,982 A | * | 6/1984 | Collins | 30/161 |
| 5,325,588 A | | 7/1994 | Rogers | |
| 5,425,175 A | | 6/1995 | Rogers | |
| 5,615,484 A | | 4/1997 | Pittman | |
| 5,815,927 A | * | 10/1998 | Collins | 30/161 |
| 6,363,615 B1 | * | 4/2002 | Moser | 30/161 |
| 6,397,477 B1 | * | 6/2002 | Collins | 30/161 |

FOREIGN PATENT DOCUMENTS

| | | |
|---|---|---|
| AT | 172086 | 8/1952 |
| DE | 29469 | 6/1884 |
| GB | 27373 | 4/1909 |
| GB | 2872 | 6/1913 |
| IT | 639239 | 5/1962 |

* cited by examiner

*Primary Examiner*—Hwei-Siu Payer
(74) *Attorney, Agent, or Firm*—Leatherwood Walker Todd & Mann, P.C.

(57) ABSTRACT

A further folding knife which automatically locks upon being moved to the open position. The knife includes a blade having a tang with a ledge portion defined in an upper region of the tang for receipt of a sliding bolt. The bolt is provided for sliding movement within a channel defined in the handle, and the bolt is urged forwardly towards the tang of the blade by a bolt spring, such as a coil spring. A band is connected at one end to the bolt, and the other end of the band is connected to a spool, which is carried for rotation within the handle. The spool can be rotated with respect to the handle to cause a winding of the band thereon, which in turn causes retraction of the bolt, such that the blade can be pivoted out of a locked extended position, towards a retracted position.

19 Claims, 3 Drawing Sheets

SELF LOCKING FOLDING KNIFE

This application claims benefit of U.S. Provisional application Serial No. 60/333,042, filed Nov. 19, 2001, the entirety of disclosure of which is incorporated herein by reference thereto.

BACKGROUND OF THE INVENTION

This invention relates generally to a knife having a handle portion and a blade connected thereto for movement between a retracted position and an extended position and which includes a locking mechanism for automatically locking the blade to the handle when the blade is moved to the extended position.

Various designs of folding knives are known having blades which lock in the open position. Typically, such folding knives include a backspring which engages the tang of the blade when the blade is in the closed position to prevent the blade from falling, or "flopping," out from the knife handle when the blade is in a closed position.

The back-spring also bears against the curved end of the tang as the blade is moved from the retracted, or closed, position to the extended, or open, position, thereby offering frictional resistance which must be overcome by the user when opening the blade. This resistance allows for positive control of the blade when the blade is moved to the open position, in that if the user releases the blade at some intermediate portion between the open and closed positions, the blade remains in place, i.e., the blade does not snap back into the closed position, which could prove injurious to the user.

While folding knives are available which allow the blade to be automatically locked once the blade is moved to the open position, such knives typically require depression of a lock bar in order to release the blade and allow the blade to be returned to the closed position. A typical lock bar extends substantially the length of the handle and is pivotally connected to the back of the handle. An elongated spring, such as a piano wire-type spring, may be used to urge upwardly on the rearward portion of the lock bar to force a locking tab provided on the forward portion of the locking bar into engagement with a notch provided in the tang of the blade. The notch in the tang is presented to the locking tab when the blade is in the open position.

In order to release the blade, the locking bar is depressed rearwardly of its pivot point, by the user using one hand, against the upward force bearing on the lock bar by the spring, in order to raise the locking tab out of engagement with the notch in the tang. By simultaneously depressing the lock bar in this manner, the user with his or other hand would then pivot the blade to the retracted position within the knife's handle.

With such conventional lock bar arrangements, the user is required to use two hands to unlock and simultaneously close the blade.

Other folding knife designs of mine have been patented, and include U.S. Pat. No. 5,815,927, for a folding knife having an actuatable blade locking mechanism, and U.S. Pat. No. 4,451,982, for a bolt action locking mechanism for a folding knife.

Accordingly, it would be desirable to have a folding knife which would allow the user to move the blade from the closed position to an open, automatically locked position, and then to unlock the blade and return it to the closed position, all while using only one hand. Another desirable feature would be a blade which is spring-assisted in its opening in order to facilitate quick availability and usability of the blade's cutting edge, with the blade being in a securely locked open configuration.

While automatic locking folding knives designs are known, there still exists a need for an improved folding knife having a blade which moves smoothly to an open position, which automatically locks when moved to the open position, and which can be unlocked and moved to the closed position, all with the use of only one hand.

SUMMARY OF THE INVENTION

It is, therefore, the principal object of this invention to provide a folding knife having an improved blade locking system.

Another object of the present invention is to provide a folding knife having an improved system for automatically locking the blade when the blade is moved to the open position.

Still another object of the present invention is to provide a folding knife having an improved retention system for securely locking the blade in the open position and for retaining the blade in the closed position.

Yet another object of the present invention is to provide a folding knife having a blade which can be opened, automatically locked, and closed, all with the use of only one hand.

It is another object of the present invention to provide a method of assembling and using a folding knife constructed in accordance with the present invention.

Generally, the present invention includes a folding knife which automatically locks upon being moved to the open position. The blade of this design includes a tang having a ledge portion defined in an upper portion of the tang for receipt of a sliding bolt. The bolt is provided for sliding movement within a channel defined in the handle, and the bolt is urged forwardly towards the tang of the blade by a bolt spring, which in one preferred embodiment is a coil spring, interposed in the channel between the bolt and a seat defined in the base of the channel.

The bolt includes an extension having a bore therethrough, and a band, wire, or cable is connected to the bore and extends through the bolt spring, the other end of the cable being connected to the bore of a spool assembly, which is carried for rotation within the handle.

By applying pressure to both sides of the spool, the spool can be rotated while the handle is held stationary (or alternately, the spool can be held stationary and the handle rotated), and this causes retraction of the bolt such that the blade can be pivoted out of the locked, extended position, towards the retracted position.

When the blade is moved from the retracted position to the extended position, the forward end of the bolt rides on a curved guide profile defined on the end of the tang to automatically lock the blade once the blade reaches the extended position.

As the blade is pivoted to the retracted position, the bolt then registers with a retention profile defined in the tang, and under the force of the bolt spring, again advances forwardly, this time into engagement with the retention profile. Thus, the blade is secured in the closed position. The spring pressure on the bolt holds the blade in the closed position, but allows the blade to be opened for use by simply pulling out on the blade with enough pressure to overcome the spring resistance.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
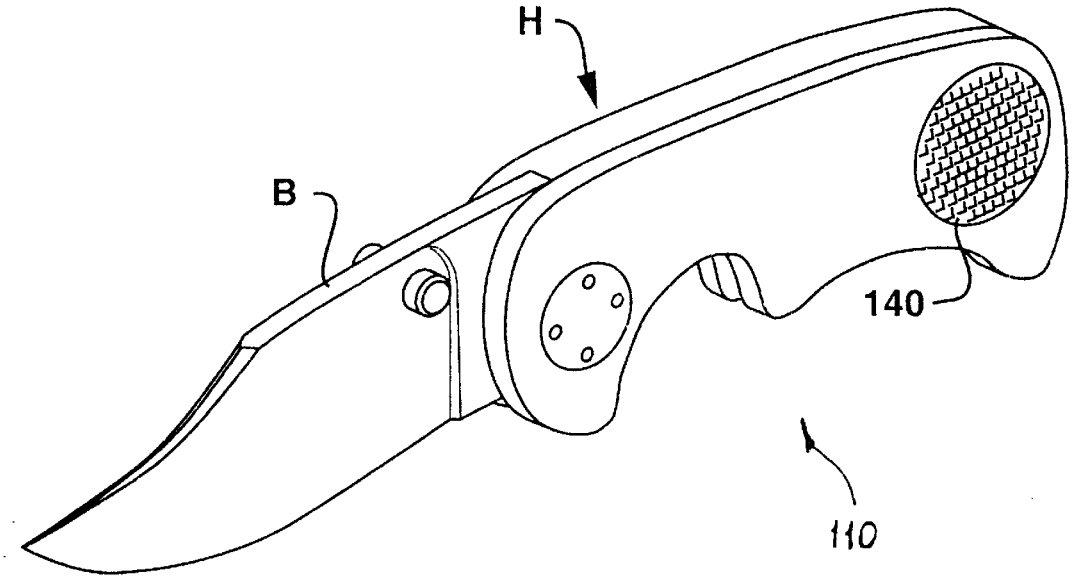
FIG. 1 is a perspective view of a folding knife constructed in accordance with the present invention, showing the blade in an extended position.

The accompanying drawings and the description which follows set forth this invention in its preferred embodiment. However, it is contemplated that persons generally familiar with folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the self-locking folding knife of the present invention is indicated generally in the figures by reference character 110.

Figure 2:
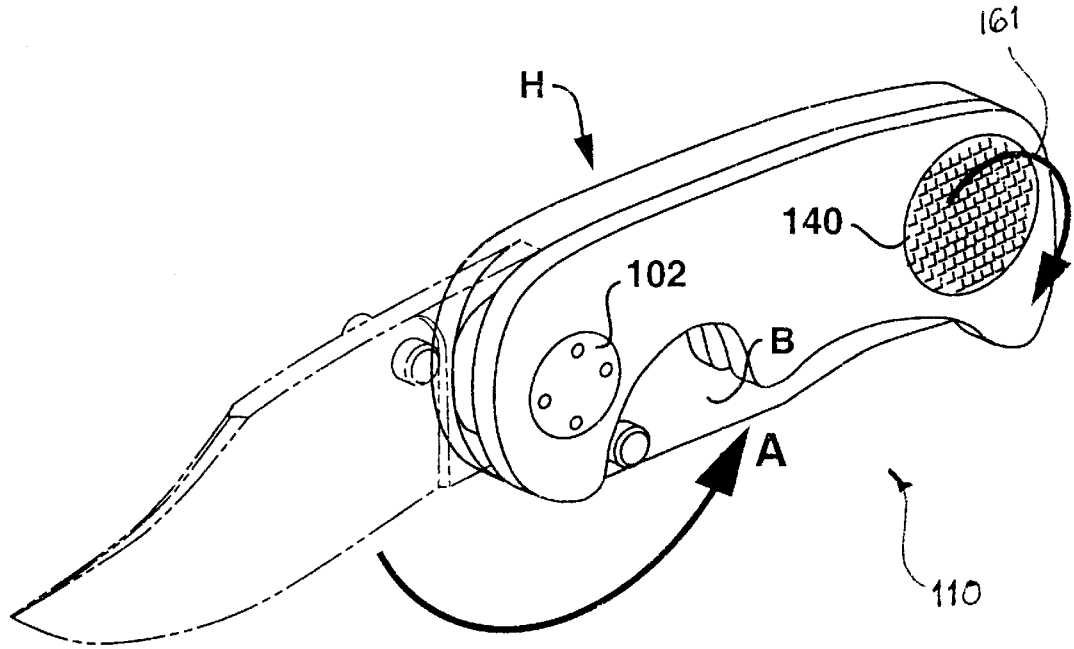
FIG. 2 is a perspective view of a folding knife constructed in accordance with the present invention, showing the blade in a retracted position.
Figure 3:
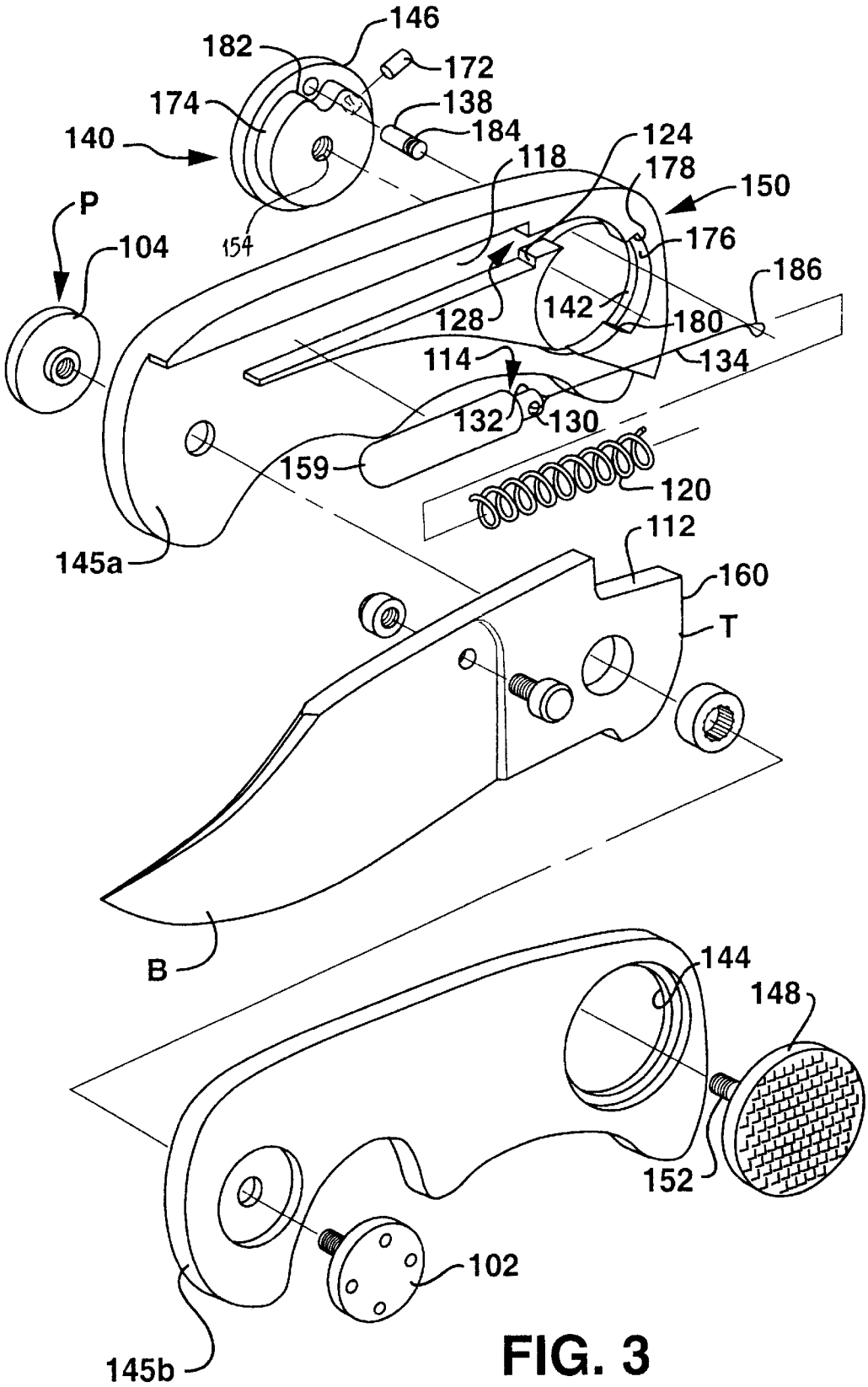
FIG. 3 is an exploded view of a folding knife constructed in accordance with the present invention.
Figure 4A:
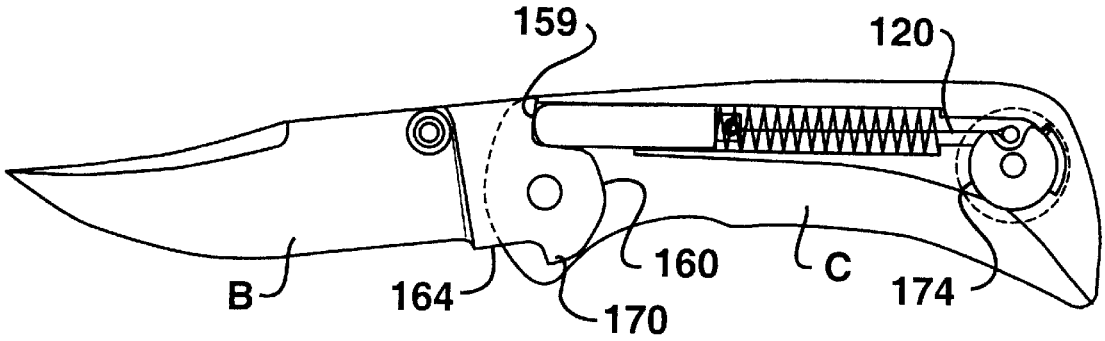
FIG. 4A is a sectional view of a folding knife constructed in accordance with the present invention, showing the blade in an extended position.

As shown in FIGS. 1–4C, the present invention includes a folding knife, generally 110, having blade B, which automatically locks upon being moved to the open position shown in FIGS. 1 and 4A. The knife 110 includes a handle member, generally H, having a blade pivotally connected thereto, the blade B being moveable on a pivot mechanism, generally P, having male member 102 and female member 104, between an open position and a closed position within a blade cavity C (FIGS. 4A–4C) defined in the handle.

As shown in FIG. 3, the blade B includes a tang T having a ledge portion 112 defined in an upper portion of the tang for receipt of a sliding bolt, generally 114. The bolt 114 is provided for sliding movement within a channel 118 defined in the handle H, and the bolt is urged forwardly towards the tang of the blade by a bolt spring, generally 120, which in one preferred embodiment is a coil spring, interposed in the channel between the bolt 114 and a seat 124 defined in the base 128 of the channel 118.

The bolt 114 includes an extension 130 having a bore 132 therethrough, and a band, wire, or cable 134 is connected to the bore 132 and extends through the bolt spring 120, the other end of the cable being connected to a post 138 mounted in a spool assembly, generally 140.

The spool assembly 140 is carried for rotation within cavities 142, 144 provided in handle portions 145*a*, 145*b*, respectively, and includes two pieces 146, 148, which are joined to one another, each of the two pieces 146, 148 being on the opposite side of a rearward end 150 of the handle H.

The piece 148 of the spool assembly includes a threaded projection 152 which is received within a threaded bore 154 of piece 146 of the spool assembly.

When the blade is moved from the retracted, or closed position (shown in FIGS. 2 and 4C), to the extended, or open, position (shown in FIGS. 1 and 4A) and is in an intermediate position (FIG. 4B), the forward end 159 of the bolt 114 rides on a curved guide profile 160 defined on the end of the tang T. Once the blade rotates to a position wherein the forward end 159 of the bolt 114 is in general alignment with the ledge 112 of the tang, the bolt 114 is advanced forward into the ledge by the bolt spring 120. This causes the blade to be automatically locked in the open position, as shown in FIG. 4A.

Figure 4B:
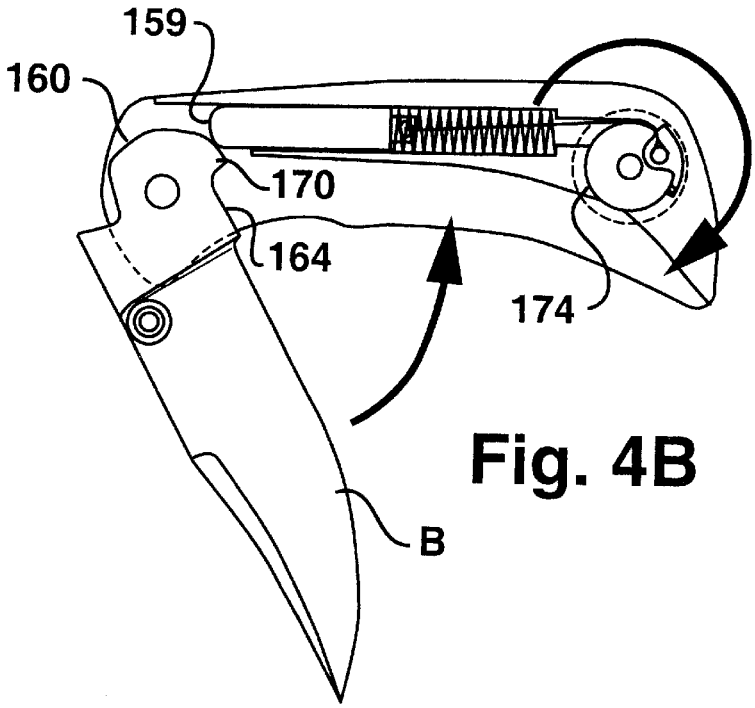
FIG. 4B is a sectional view of a folding knife constructed in accordance with the present invention, showing the blade in an intermediate position, between the extended and retracted positions.

In order to close the blade, the user would rotate the spool assembly 140 in the direction shown by arrow 161 in FIG. 2 with the thumb and fingers in order to wind the cable 134 thereon, which correspondingly causes the bolt 114 to move rearwardly, such that continued turning of the spool 140 causes the bolt 114 to disengage entirely from the ledge, thereby allowing the user, again with the same hand, to pivot the blade from the open position to the closed position. Once the user turns the spool a sufficient amount such that the bolt 114 no longer engages the ledge 112, and begins pivoting the blade towards the closed position, the user may release the spool assembly 140, and allow the end of the bolt to ride upon the guide profile 160 on the tang. This provides a frictional resistance in the closing of the blade, thereby giving the user more control in closing the blade and preventing the blade from swinging freely with respect to the handle. FIG. 4B shows the blade in an intermediate position between the extended and retracted positions.

Figure 4C:
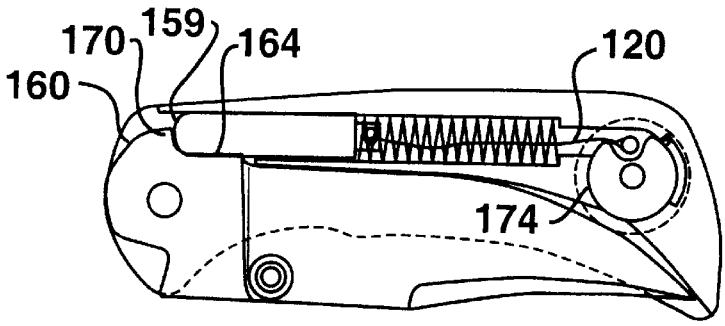
FIG. 4C is a sectional view of a folding knife constructed in accordance with the present invention, showing the blade in a retracted position.

As the blade is pivoted further and into the closed position in the direction shown by arrow A in FIG. 2, the bolt then registers with a retention profile 164 defined in the tang, generally opposite the ledge 112, and under the force of the bolt spring, again advances forwardly, this time into engagement with a stop 170 at the end of the retention profile 164 (FIG. 4C). Thus the blade is automatically secured in the closed position.

As shown in FIG. 3, spool 140 may preferably include a pin 172 which extends radially outwardly from a generally cylindrical rim 174 of spool member 146 towards the outer edge of another generally cylindrical rim 176 of handle H, which is a larger diameter than rim 174. Pin 172 acts as a stop to prevent spool 140 from being rotated too far in the wrong direction, i.e., in a clockwise direction, as shown in FIG. 4B, which could tend to compress cable 134 and perhaps cause cable 134 to become kinked or entangled, instead of having it generally in a state of tension, or, at a minimum, unkinked. By contacting handle stops 178, 180, pin 172 limits the arc through which spool 140 may rotate. The length of the arc through which spool 140 may turn may vary, depending on the application, but in one preferred embodiment is between 60 and 70 degrees, and more specifically, 67 degrees. It is to be understood, however, that the present invention is not limited to a particular arc length.

As illustrated in FIG. 3, cable attachment means for attaching the end of cable 134 to spool member 146, include a recess 182 provided in spool member 146, having pin 138 pressed therein. Pin 138 includes a groove 184 which receives the end of cable 134, such end preferably being in the form of a loop 186.

In order to withdraw the blade from the blade cavity and move it from the closed position to the open position, the blade is pivoted towards the extended position by the user, such pivoting causing stop 170 to depress bolt 114 a sufficient distance such that the bolt 114 clears stop 170 and no longer registers with the retention profile 164 of the blade. At this point, the blade can be pivoted, and bolt 114, under the influence of spring 120, again bears upon the guide profile 160 of the tang T in the pivoting of the blade smoothly from the closed position to the open position by the user.

Knife 100 can be constructed of a variety of materials. Handle H could be of molded material, such as plastic or glass-filled nylon, or could be made of metal, wood, bone, or any other suitable material. Blade B are preferably made of cutlery steel, and the springs used in the designs could be coil springs as shown, or other types of resilient members.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of this invention and the following claims.

What is claimed is:

1. A folding knife, comprising:

an elongated handle;

a blade connected to said handle for movement between an extended position extending outwardly from said handle and a retracted position substantially adjacent said handle;

a locking member movable between a locked position for locking said blade in said extended position and an unlocked position for allowing said blade to move from said extended position to said retracted position;

a spring member for urging said locking member towards said locked position, such that upon said blade moving to said extended position, said locking member moves to said locked position to automatically lock said blade in said extended position;

a winding member carried for rotating movement by said handle;

a flexible link member connected to said winding member and said locking member, such that upon selective rotating of said winding member with respect to said handle, said winding member winds said flexible link member thereon and said flexible link member moves said locking member from said locked position to said unlocked position.

2. A folding knife as defined in claim 1, wherein said handle defines a channel for carrying said locking member for generally rectilinear motion.

3. A folding knife as defined in claim 1, wherein said handle defines a channel for carrying said locking member for generally rectilinear motion; said channel having a seat therein configured for receipt of one end of said spring member.

4. A folding knife as defined in claim 1, wherein said handle defines an exterior portion, and wherein said winding member extends outwardly from said exterior portion.

5. A folding knife as defined in claim 1, wherein said handle defines a cavity for receipt of said winding member.

6. A folding knife as defined in claim 1, wherein said blade includes a recess for receipt of said locking member upon said locking member being in said locked position.

7. A folding knife as defined in claim 1, wherein said blade includes a recess for receipt of said locking member upon said blade being in said retracted position.

8. A folding knife as defined in claim 1, wherein said blade includes a stop, said locking member bearing against said stop upon said blade being in said retracted position.

9. A folding knife as defined in claim 1, wherein said blade includes a stop, said locking member bearing against said stop upon said blade being in said retracted position; and said stop being configured to move said locking member to said unlocked position upon said blade being moved from said retracted position towards said extended position.

10. A folding knife as defined in claim 1, wherein said blade includes a curved end portion, and said locking member being configured to bear against said curved end portion as said blade is moved from said retracted position towards said extended position.

11. A folding knife as defined in claim 1, wherein said locking member is elongated and includes a first end for engaging said blade when said blade is in said extended position and a second end having an opening for receipt of said flexible link member.

12. A folding knife as defined in claim 1, wherein said locking member moves generally rectilinearly between said locked and unlocked positions, and wherein said handle defines a channel for carrying said locking member as said locking member moves between said locked and unlocked positions.

13. A folding knife as defined in claim 1, wherein said spring member is a coil spring.

14. A folding knife as defined in claim 1, wherein said spring member is a coil spring generally encircling said flexible link member.

15. A folding knife as defined in claim 1, wherein said winding member includes a generally cylindrical portion.

16. A folding knife as defined in claim 1, wherein said winding member includes a stop for, limiting the extent to which said winding member can rotate.

17. A folding knife as defined in claim 1, wherein said flexible link member is a cable.

18. A folding knife, comprising:

an elongated handle;

a blade connected to said handle for movement between an extended position extending outwardly from said handle and a retracted position substantially adjacent said handle;

a locking member movable generally rectilinearly between a locked position for locking said blade in said extended position and an unlocked position for allowing said blade to move from said extended position to said retracted position;

said blade including a recess for receipt of said locking member upon said locking member being in said locked position; said blade including a first recess for receipt of said locking member upon said blade being in said retracted position; and said blade further including a stop, said locking member bearing against said stop upon said blade being in said retracted position; and said stop being configured to move said locking member to said unlocked position upon said blade being moved from said retracted position towards said extended position;

said handle defining a channel for carrying said locking member moves between said locked position and said unlocked position;

a spring member for biasing said locking member towards said locked position, such that upon said blade moving to said extended position, said locking member moves to said locked position to automatically lock said blade in said extended position;

a winding member carried for rotating movement by said handle;

a cable connected to said winding member and said locking member, such that upon selective rotating of said winding member with respect to said handle, said winding member winds said cable thereon and said cable moves said locking member from said locked position to said unlocked position.

19. A folding knife, comprising:

an elongated handle;

a blade connected to said handle for movement between an extended position extending outwardly from said handle and a retracted position substantially adjacent said handle;

a locking member movable between a locked position for locking said blade in said extended position and an unlocked position for allowing said blade to move from said extended position to said retracted position;

a spring member for urging said locking member towards said locked position, such that upon said blade moving to said extended position, said locking member moves to said locked position to automatically lock said blade in said extended position;

a flexible link member connected to said locking member; and winding means connected to said locking member, such that upon winding of said winding means, said winding means wind said flexible link member thereon and said flexible link member moves said locking member from said locked position to said unlocked position.

* * * * *